US008591995B2

(12) United States Patent
Wachi

(10) Patent No.: US 8,591,995 B2
(45) Date of Patent: Nov. 26, 2013

(54) METHOD FOR TRANSFERRING FRESHLY COATED GOLF BALL

(75) Inventor: Toshiro Wachi, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 854 days.

(21) Appl. No.: 11/927,873

(22) Filed: Oct. 30, 2007

(65) Prior Publication Data

US 2009/0110837 A1 Apr. 30, 2009

(51) Int. Cl.
*B05D 3/12* (2006.01)

(52) U.S. Cl.
USPC ..... 427/350; 427/372.2; 427/385.5; 427/421.1; 118/50; 118/62; 118/300; 118/500

(58) Field of Classification Search
None
See application file for complete search history.

(56) References Cited

U.S. PATENT DOCUMENTS

| | | | | |
|---|---|---|---|---|
| 2,079,614 | A * | 5/1937 | Holt et al. | 118/58 |
| 2,819,108 | A * | 1/1958 | Borah | 294/19.2 |
| 3,112,521 | A * | 12/1963 | Ward | 425/126.1 |
| 4,021,068 | A * | 5/1977 | Piazza | 294/19.2 |
| 5,506,004 | A * | 4/1996 | Maruoka et al. | 427/425 |
| 6,146,288 | A * | 11/2000 | Crast et al. | 473/377 |
| 6,319,563 | B1 * | 11/2001 | Skrabski et al. | 427/511 |
| 2003/0221615 | A1 * | 12/2003 | Lastowka | 118/679 |
| 2004/0043836 | A1 * | 3/2004 | Isogawa | 473/351 |
| 2005/0202886 | A1 * | 9/2005 | Furze et al. | 473/151 |
| 2005/0282661 | A1 * | 12/2005 | Fujisawa et al. | 473/378 |

FOREIGN PATENT DOCUMENTS

| | | | |
|---|---|---|---|
| JP | 51-85161 | A | 7/1976 |
| JP | 08-318186 | A | 3/1996 |
| JP | 2002-143349 | A | 5/2002 |
| JP | 2002-024840 | A | 7/2002 |
| JP | 2003-000766 | A | 1/2003 |
| JP | 2003-052859 | A | 2/2003 |
| JP | 2004-187829 | A | 7/2004 |

OTHER PUBLICATIONS

Japanese Office Action dated Oct. 23, 2012 issued in Japanese Application No. 2008-276393.

* cited by examiner

*Primary Examiner* — Robert S Walters, Jr.
(74) *Attorney, Agent, or Firm* — Sughrue Mion, PLLC

(57) ABSTRACT

There are provided a golf ball having a paint coating that is prevented from being unevenly distributed over the ball surface, and a method and apparatus for manufacturing the golf ball. The method for manufacturing the golf ball comprises the steps of coating the surface of the golf ball with paint in a painting section; transferring the coated golf ball from the painting section to a drying section; and drying the coated golf ball in the drying section. The transferring step comprises attaching the coated golf ball to a moving unit by suction in the painting section; moving the moving unit to which the golf ball is attached by suction from the painting section to the drying section; and blowing gas to the golf ball toward the direction opposite to the suction direction for attaching the golf ball to release the golf ball from the moving unit in the drying section.

11 Claims, 2 Drawing Sheets

METHOD FOR TRANSFERRING FRESHLY COATED GOLF BALL

BACKGROUND OF THE INVENTION

The present invention relates to a method for transferring a golf ball freshly coated with paint. Also, the present invention relates to a method and apparatus for manufacturing a golf ball, comprising a step or means for transferring a golf ball freshly coated with paint.

Generally, golf balls are classified into a solid golf ball such as one-piece golf ball, a two-piece golf ball, and a three-piece golf ball, and a thread-wound golf ball. For any kind of golf balls, the ball surface is coated with paint.

Japanese Patent Application Publication No. 2002-204840 describes a method for painting a golf ball. In this painting method, a golf ball is placed on a plurality of prong bodies and the whole surface of the golf ball is coated with a paint by using a spray gun, and thereafter the freshly coated golf ball is transferred from the prong bodies to a drying tray by holding both sides of the freshly coated golf ball by a supporter having a plurality of claws.

A problem with the above-described method is that when the freshly coated golf ball is transferred by the method described in the above-described publication, an indication or seal such as a trademark, a logotype, a number, and the like printed or affixed on the side surface of golf ball may blur or shift. There is also a problem that since the golf ball must be held by a strong force using the claws, the coated surface of golf ball may be damaged.

Also, Japanese Patent Application Publication No. 8-318186 describes a method for painting a golf ball, in which a golf ball is placed on a plurality of needle-shaped members and the whole surface of the golf ball is coated with a paint by using a spray gun, and thereafter the painted golf ball is dried in a state of being placed on the needle-shaped members.

In the methods described in the above-described two publications, the painted golf ball does not rotate around its horizontal axis during the time from painting to finish of drying. Therefore, the paint applied to the ball surface may be distributed unevenly between the top and bottom of the ball. The unevenness of paint applied to the golf ball not only may mar the aesthetic appearance of golf ball but also may mar the symmetry of golf ball and may upset the balance of the volume, diameter, depth, and the like of dimples formed uniformly, thereby degrading the aerodynamic characteristics of golf ball.

SUMMARY OF THE INVENTION

In order to solve the problems discussed above, an object of the present invention is to provide a golf ball having a paint coating that is prevented from being unevenly distributed over the ball surface, and a method and apparatus for manufacturing the golf ball.

Another object of the present invention is to provide a golf ball whose aesthetic appearance, inherent symmetry, and aerodynamic characteristics are all maintained, and a method and apparatus for manufacturing the golf ball.

One aspect of the present invention provides a method for manufacturing a golf ball, comprising the steps of coating the surface of a golf ball with paint in a painting section; transferring the coated golf ball from the painting section to a drying section; and drying the coated golf ball in the drying section, wherein the transferring step comprises attaching the coated golf ball to a moving unit by suction in the painting section; moving the moving unit to which the golf ball is attached by suction from the painting section to the drying section; and blowing gas to the golf ball toward the direction opposite to the suction direction for attaching the golf ball to release the golf ball from the moving unit in the drying section.

In the transferring step, the coated golf ball can be sucked with an air velocity of about 5 to about 15 m/s. In the transferring step, the gas can be blown to the golf ball with an air velocity of about one third to about two thirds the air velocity at the time of suction.

In the coating step, the golf ball can be coated with a urethane paint in which one or more kinds of resins selected from polyester, acrylic, and polyether resins are used as a base. In the coating step, the golf ball can be coated with a paint having a viscosity of about 10 to about 100 mPa·s at 20° C. The golf ball can be coated in the coating step so that a coat of the golf ball dried in the drying step has a thickness of about 3 to about 30 μm.

Another aspect of the present invention provides an apparatus for manufacturing a golf ball, comprising a painting section for coating the surface of a golf ball with paint; a transferring section for transferring the coated golf ball from the painting section to a drying section; and a drying section for drying the coated golf ball, wherein the transferring section comprises a moving unit, the moving unit comprising a suction port for sucking the coated golf ball to attach it to the moving unit, and the moving unit moving from the painting section to the drying section, and the suction port comprises at least three needle-shaped members, of which the tip ends support the coated golf ball when the coated golf ball is sucked by the suction port.

The suction port can be configured so as to suck the coated golf ball with an air velocity of about 5 to about 15 m/s. Also, the suction port can be configured so as to blow gas to the coated golf ball by a changeover from suction to blow. Further, the suction port can be configured so as to blow gas to the coated golf ball with an air velocity of about one third to about two thirds the air velocity at the time of suction. The moving unit can be configured so that the coated golf ball is attached in a state of being hung from the moving unit.

Still another aspect of the present invention provides a golf ball manufactured by the above-described method or apparatus for manufacturing a golf ball. A coat on the surface of the golf ball may have a thickness of about 3 to about 30 μm. The coat can be uniformly deposited on the surface of the golf ball.

BRIEF DESCRIPTION OF THE DRAWINGS

One embodiment according to the present invention will now be described by reference to the following drawings.

DETAILED DESCRIPTION OF THE PREFERRED EMBODIMENT

Figure 1:
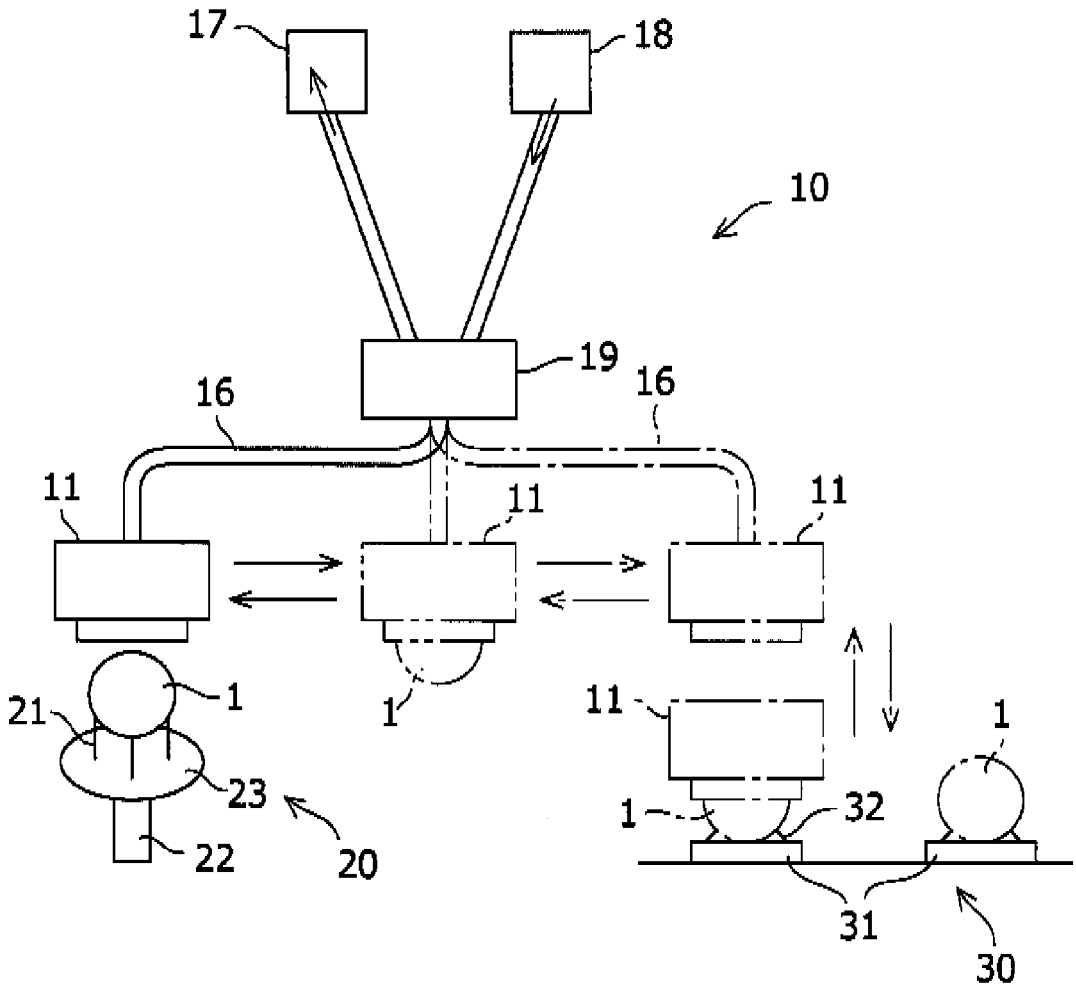
FIG. 1 is a schematic view showing one embodiment of an apparatus for manufacturing a golf ball in accordance with the present invention.

As shown in FIG. 1, one embodiment of an apparatus for manufacturing a golf ball in accordance with the present invention mainly comprises a painting section 20 for coating a golf ball 1 with paint, a drying section 30 for drying the coated golf ball 1, and a transferring section 10 for transferring the golf ball 1 from the painting section to the drying section. An unpainted golf ball is supplied to the painting section 20. As the unpainted golf ball, for example, a solid golf ball such as a two-piece golf ball in which a cover layer is formed on a core material, or a three-piece golf ball in which an intermediate layer is formed between the core material and the cover layer is generally used although the unpainted ball is not limited to these types of golf balls.

In the painting section 20, the golf ball 1 is supported by the tip ends of a plurality of needle-shaped members 21 extending vertically. The opposite ends of the needle-shaped members 21 are fixed to a horizontal painting bed 23. The painting bed 23 is configured so as to be capable of being rotated by a painting bed bearer 22. Also, in the painting section 20, a spray gun (not shown) for applying a paint to the surface of golf ball is provided. By the rotation of the painting bed 23, the golf ball 1 on the needle-shaped members 21 is also rotated. At this time, by spraying the paint onto the golf ball 1, a clear coat layer can be formed on the whole surface of golf ball.

As shown in FIG. 1, by arranging at least three needle-shaped members, a force is applied evenly from the golf ball to the needle-shaped members, so that the golf ball can be held stably. It is preferable that the number of needle-shaped members attached to one painting bed 23 be as small as possible. For example, three to six needle-shaped members can be used. The material of the needle-shaped members 21 is generally iron although not limited to this material, and the surfaces thereof may be coated with Teflon. By the use of the needle-shaped members configured as described above, the golf ball can be prevented from being damaged.

The needle-shaped members are preferably arranged so as to be positioned at the vertexes of a regular polygon such as a regular triangle although the arrangement thereof is not limited to this arrangement. The lower limit of the length of one side of the regular polygon is preferably about 10 mm, further preferably about 15 mm, and still further preferably about 20 mm. Also, the upper limit thereof is preferably about 40 mm, further preferably about 35 mm, and still further preferably about 30 mm. In the case where the length of one side of the regular polygon is within this range, the golf ball can be held surely, and the golf ball surface, which is a spherical surface, can be painted uniformly.

As the spray gun (not shown), a general-purpose gun, an electrostatic gun, or a low-pressure gun can be used although the spray gun is not limited to these types. A paint can be sprayed from the spray gun by the flat spraying method although the spraying method is not limited to this method. The lower limit of the distance between the spray gun and the golf ball is preferably about 100 mm, further preferably about 125 mm, and still further preferably about 150 mm. Also, the upper limit thereof is preferably about 300 mm, further preferably about 250 mm, and still further preferably about 200 mm.

As the paint, a material that has usually been used as a painting material for a golf ball can be used. As the paint, a urethane paint in which one or more kinds of resins selected from, for example, polyester resin, acrylic resin, and polyether resin are used as a base can be used although the kind of paint is not limited to these kinds. The specific gravity of the paint is preferably about 0.90 to about 1.00. The viscosity of the paint at 20° C. is preferably about 10 to about 100 mPa·s.

In the transferring section 10, a moving unit 11 is configured so as to move between the painting section 20 and the drying section 30. The moving unit 11 is connected to a suction pump 17 and a blow pump 18 via a pipe 16. The pipe 16 between the moving unit and these pumps is provided with a selector valve 19 capable of changing over from suction to blow and vice versa. The pipe 16 is flexible, and has a length enough to move the moving unit 11 between the painting section 20 and the drying section 30.

Figure 2:
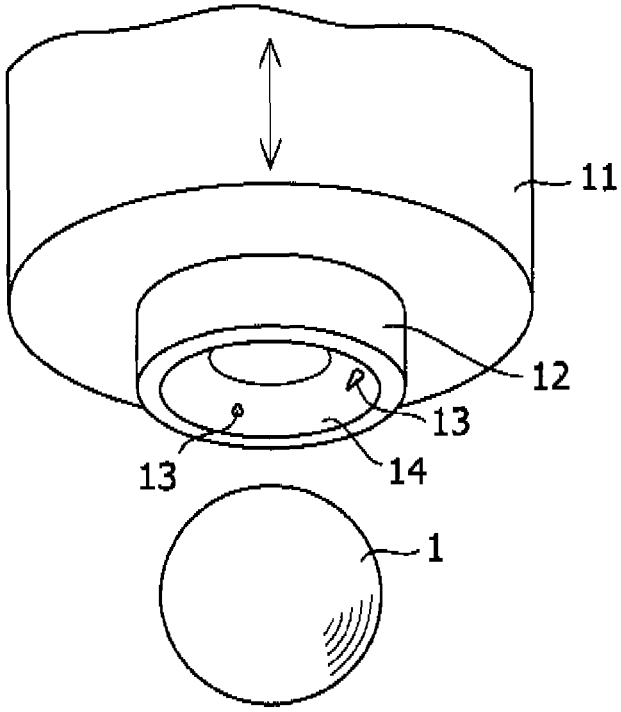
FIG. 2 is a perspective view enlargedly showing a suction port of a moving unit shown in FIG. 1.
Figure 3:
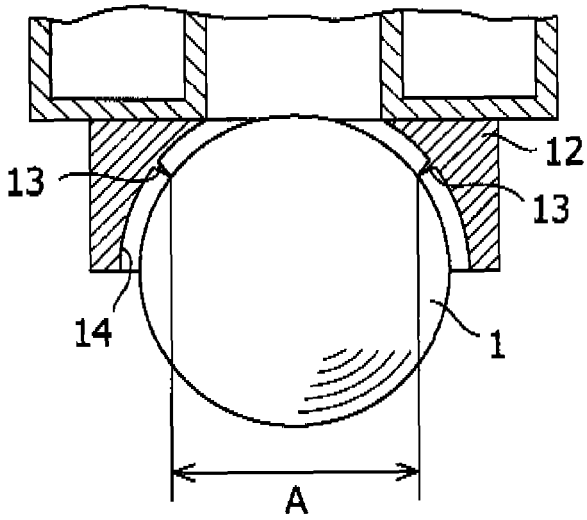
FIG. 3 is a sectional view enlargedly showing a suction port of a moving unit shown in FIG. 1.

As shown in FIGS. 2 and 3, on the bottom surface of the moving unit 11, a suction port 12 communicating with the suction pump 17 and the blow pump 18 is provided. In the suction port 12, a seat part 14 that is curved corresponding to the spherical surface of golf ball is provided to accommodate the golf ball 1. On the surface of the seat part 14, a plurality of needle-shaped members 13 projecting toward the golf ball 1 are arranged. The seat part 14 shown in FIGS. 2 and 3 is one example, and the present invention is not limited to this example. Any other member that can arrange the needle-shaped members 13 in the suction port 12 may be provided.

As shown in FIG. 3, the tip end part of the suction port 12 can be of a circular shape having a diameter enough to accommodate about a half of the golf ball 1 although the shape of the tip end part of the suction port 12 is not subject to any special restriction. The needle-shaped members 13 in the seat part 14 may be provided slantwise toward the center of the golf ball 1 as shown in FIGS. 2 and 3, or may be provided in parallel with each other in the vertical direction.

The lower limit of the diameter A of an imaginary circle connecting the tip ends of the needle-shaped members 13 is preferably about 10 mm, further preferably about 20 mm, and still further preferably about 23 mm. Also, the upper limit thereof is preferably about 43 mm, further preferably about 30 mm, and still further preferably about 28 mm.

Other configurations of the needle-shaped members 13 of the suction port 12 can be made similar to the configuration of the above-described needle-shaped members in the painting section. The golf ball 1 is sucked from the suction port 12 and also is supported by the tip ends of the needle-shaped members 13, by which the golf ball 1 is attracted to the moving unit 11. Since the contact area between the needle-shaped members and the golf ball is small, even the golf ball in a wet state in which the applied paint is not yet dried can be attracted to the moving unit.

The shape of the needle-shaped member is not limited to the shape shown in FIGS. 2 and 3. Any shape that can hold the golf ball firmly without damaging the surface of golf ball can be employed.

As the suction pump 17, a high-output pump having a suction force enough to suck and attract the golf ball at a remote position is preferably used. The lower limit of the suction air velocity at the suction port 12 is preferably about 5 m/s, further preferably about 6 m/s, and still further preferably about 7 m/s. Also, the upper limit thereof is preferably about 15 m/s, further preferably about 13 m/s, and still further preferably about 10 m/s. By setting the suction air velocity within this range, the golf ball can be held properly by the suction port, and the rolling and movement of the golf ball can be prevented effectively.

If the suction air velocity is lower than the above-described lower limit, the golf ball cannot be fixed firmly, and therefore the golf ball may move on the needle-shaped members 13, so that the paint may be peeled off, or flaws may be developed. On the other hand, if the suction air velocity is higher than the above-described upper limit, an excess force is applied to the golf ball from the needle-shaped members, so that not only the clear coat layer produced by painting but also the cover layer under the clear coat layer may be peeled off or damaged.

After the moving unit 11 has been moved from the painting section 20 to the drying section 30, the suction pump 17 is stopped to separate the golf ball 1 from the moving unit 11. Thereby, the golf ball 1 is dropped from the moving unit 11 by the gravity of golf ball. The moving unit 11 can move in the horizontal direction and the vertical direction. The moving unit 11 is lowered until the golf ball 1 is placed on a drying pallet 31 of the drying section 30.

During the time when the golf ball 1 is attracted to the moving unit 11, the paint on the golf ball surface is sucked by the suction pump 17, and therefore is distributed unevenly so as to go to the suction side. Therefore, after the golf ball 1 has been separated from the moving unit 11, a gas such as air is blown toward the golf ball 1 from the suction port 12 to return the paint on the golf ball surface to an even state. The gas can be blown out of the suction port 12 by causing the blow pump 18, instead of the suction pump 17, to communicate with the suction port 12 by operating the selector valve 19. By accomplishing the suction and blow by using one suction port 12, the suction direction and the blow direction can be made the exact opposite directions.

The blow air velocity at the suction port 12 is preferably about one third to about two thirds the suction air velocity. The lower limit of the blow air velocity at the suction port 12 is preferably about 2 m/s, and further preferably about 3 m/s. Also, the upper limit thereof is preferably about 5 m/s, and further preferably about 4 m/s. If the air velocity is lower than the above-described lower limit, the paint does not sometimes return to an even state. On the other hand, if the air velocity is higher than the above-described upper limit, the golf ball 1 is pressed downward than necessary, by which the golf ball 1 may be damaged.

In place of the two pumps of the suction pump 17 and the blow pump 18 shown in FIG. 1, one pump capable of accomplishing both of suction and blow may be provided. Thereby, space saving can be achieved.

In the drying section 30, a plurality of drying pallets 31 for placing the painted golf ball to dry it are provided. On each of the drying pallets 31, a plurality of needle-shaped members 32 for supporting the golf ball are provided. The needle-shaped members 32 may have a configuration that is same as that of the above-described needle-shaped members in the painting section, or may have a configuration that is different from that of the needle-shaped members in the painting section. The needle-shaped members 32 in the drying section 30 shown in FIG. 1 is provided so as to be inclined toward the center direction of the members 32, not in parallel with each other.

The drying pallets 31 can be arranged so as to be in a line at equal intervals. It is desirable that the drying pallets 31 be arranged so that the lower limit of the distance between the adjacent golf balls is preferably about 10 mm, further preferably about 15 mm, and still further preferably about 20 mm, and the upper limit thereof is preferably about 40 mm, further preferably about 35 mm, and still further preferably about 30 mm. If the distance between the golf balls is shorter than the above-described lower limit, the golf balls may come into contact with each other, or when air is blown to the golf ball from the suction port 12, air may also be blown to the adjacent golf ball, whereby making the paint of the adjacent golf ball uneven.

The lower limit of the thickness of the paint of the dried golf ball, that is, the thickness of the clear coat layer is preferably about 3 μm, further preferably about 5 μm, and still further preferably about 10 μm. Also, the upper limit thereof is preferably about 30 μm, further preferably about 25 μm, and still further preferably about 20 μm. If the thickness of the paint is smaller than the above-described lower limit, the paint cannot sometimes be applied to the golf ball surface evenly. On the other hand, if the thickness of the paint is larger than the above-described upper limit, the spinning characteristics and the aerodynamic characteristics of the golf ball may be degraded. Painting is performed in the painting section 20 so that the thickness of the paint after being dried is within the above-described range.

By using the apparatus for manufacturing a golf ball shown in FIGS. 1 to 3, a golf ball was painted, transferred, and dried. A golf ball the cover material of which consists of a resin was placed on three needle-shaped members in the painting section, and the golf ball was spray painted. Thereafter, before drying, the golf ball was sucked from the suction port with an air velocity of 8 m/s, and thereby the painted golf ball was attracted to the moving unit via three needle-shaped members. Then, the golf ball was transferred to the drying section. In the drying section, after the golf ball had been placed on the drying pallet, air was blown to the golf ball from the suction port with an air velocity of 3 m/s.

When being placed onto the drying pallet from the moving unit, the painted golf ball did not roll. Therefore, air could be blown from the suction port to a portion of golf ball that is identical to the portion having been sucked from the suction port. After about 50 minutes had elapsed on the drying pallet, the golf ball was taken out. This dried ball had been painted evenly and therefore had a good appearance.

What is claimed is:

1. A method for manufacturing a golf ball, comprising:

coating the surface of a golf ball in a painting section with paint;

transferring the coated golf ball from the painting section to a drying section; and drying the coated golf ball in the drying section, wherein the transferring step comprises attaching the coated golf ball to a moving unit by suction in the painting section; moving the moving unit to which the golf ball is attached by suction from the painting section to the drying section; and blowing gas to the golf ball in a direction opposite to a suction direction in order to release the golf ball from the moving unit in the drying section; and wherein the suction and blowing gas are applied to the golf ball through a valve which is connected to a suction pump and a blow pump or is connected to a pump capable of accomplishing both suction and blowing gas.

2. The method for manufacturing a golf ball according to claim 1, wherein the coated golf ball is sucked with an air velocity of about 5 to about 15 m/s in the transferring step.

3. The method for manufacturing a golf ball according to claim 2, wherein in the transferring step, the gas is blown to the golf ball with an air velocity of about one third to about two thirds the air velocity at the time of suction.

4. The method for manufacturing a golf ball according to claim 1, wherein in the coating step, the golf ball is coated with a urethane paint in which one or more kinds of resins selected from polyester, acrylic, and polyether resins are used as a base.

5. The method for manufacturing a golf ball according to claim 1, wherein in the coating step, the golf ball is coated with a paint having a viscosity of about 10 to about 100 mPa·s at 20° C.

6. The method for manufacturing a golf ball according to claim 1, wherein the golf ball is coated in the coating step so that a coat of the golf ball dried in the drying step has a thickness of about 3 to about 30 μm.

7. The method for manufacturing a golf ball according to claim 1, wherein the drying step comprises blowing gas to the golf ball in order to return the paint on the surface of the golf ball to an even state.

8. The method for manufacturing a golf ball according to claim 1, wherein in the coating step, the distance between the golf ball and a spray gun for spraying the paint thereon ranges from about 100 mm to about 300 mm.

9. The method for manufacturing a golf ball according to claim 1, wherein in the transferring step, the moving unit comprises a suction port, the suction port comprising a seat part that is curved corresponding to the spherical surface of golf ball.

10. The method for manufacturing a golf ball according to claim 1, wherein in the transferring step, the moving unit comprises a suction port, the suction port comprising a seat part, a plurality of needle-shaped members projecting toward the golf ball being arranged on the surface of the seat part, the diameter of an imaginary circle connecting the tip ends of the needle-shaped members ranging from about 10 mm to about 30 mm.

11. The method for manufacturing a golf ball according to claim 1, wherein in the transferring step, the blowing gas is blown through the moving unit.

* * * * *